United States Patent [19]

Kono et al.

[11] Patent Number: 4,801,497

[45] Date of Patent: Jan. 31, 1989

[54] RECORDING MEDIUM

[75] Inventors: Shunzo Kono, Yokosuka; Hidemasa Mouri; Michiaki Tobita, both of Yokohama; Masahiko Ishida, Fujisawa; Naonobu Eto, Yamato; Takashi Akiya, Yokohama; Shigeo Toganoh; Masahiko Higuma, both of Tokyo; Mamoru Sakaki, Hiratsuka; Ryuichi Arai, Sagamihara, all of Japan

[73] Assignee: Canon Kabushiki Kaisha, Tokyo, Japan

[21] Appl. No.: 937,686

[22] Filed: Dec. 4, 1986

[30] Foreign Application Priority Data

Dec. 11, 1985 [JP] Japan ..... 60-276679

[51] Int. Cl.[4] ..... B41M 5/00

[52] U.S. Cl. ..... 428/332; 346/135.1; 428/195; 428/211; 428/334; 428/335; 428/336; 428/409; 428/483; 428/520; 428/522

[58] Field of Search ..... 427/261; 428/195, 211, 428/537.5, 332, 334–336, 409, 483, 520, 522, 914; 346/135.1

[56] References Cited

U.S. PATENT DOCUMENTS

| | | | |
|---|---|---|---|
| 4,503,111 | 3/1985 | Jaeger | 428/195 |
| 4,550,053 | 10/1985 | Arai | 428/304.4 |
| 4,636,805 | 1/1987 | Togahoh et al. | 428/211 |
| 4,642,247 | 2/1987 | Mouri | 427/214 |
| 4,701,837 | 10/1987 | Sakaki | 428/195 |

*Primary Examiner*—John E. Kittle
*Assistant Examiner*—P. R. Schwartz
*Attorney, Agent, or Firm*—Fitzpatrick, Cella, Harper & Scinto

[57] ABSTRACT

A recording medium comprises an ink receiving layer provided on a substrate, wherein said ink receiving layer contains a cationically modified product of polyvinyl alcohol and a water soluble polymer having no active hydrogen.

30 Claims, No Drawings

RECORDING MEDIUM

BACKGROUND OF THE INVENTION

1. Field of the Invention

The present invention relates to a recording medium suitable for recording by use of ink, and, particularly, to a recording medium excellent in the ink receptivity and sharpness of recorded images, and having good light fastness and good blocking resistance.

2. Description of the Related Art

In ink jet recording processes, recording is carried out by forming ink droplets according to various ink (or recording liquid) ejection methods, for example, an electrostatic attraction method, a method in which mechanical vibration or displacement is applied to ink by use of a piezoelectric element, a method in which the pressure generated by heating ink and forcing it to foam is utilized, and so forth; and flying the droplets so that some or all of them are adhered on a recording medium such as paper. The process has been noted as a recording process that is substantially free from noise and can perform high-speed and multi-color printing.

As ink jet recording ink, those mainly comprised of water and hydrophilic solvents are used in view of safety and recording performance, and polyvalent alcohols are often added thereto to prevent nozzles from clogging and improve the ejection stability.

As recording media used in the ink jet recording process, there have been hitherto used those comprising a porous ink receiving layer provided on an ordinary paper or on a substrate called an ink jet recording paper. However, accompanying improved performance (such as increasing high-speed or multi-color recording) and widespread use of ink jet recording devices, properties in higher grade and wider range have been increasingly required also in respect of the recording media. Namely, it is necessary for a recording medium used in ink jet recording for obtaining recorded images having high resolution and high quality, to satisfy fundamental requirements that;

(1) ink is received in the recording medium as quickly as possible;

(2) even when ink dots have been overlapped, the ink adhered later may not flow into the dots adhered earlier;

(3) ink droplets may not diffuse over the recording medium to excessively enlarge the size of ink dots;

(4) the ink dots are substantially round with smooth peripheries;

(5) the ink dots have a high OD (optical density), and are free from unclearness around the dots; etc.

In addition to the performance characteristics required above the following characteristics are further required when recorded images having high resolution comparable to color photographs are to be obtained by a multi-color ink jet recording process:

(6) Coloring components of the ink have a good coloring property;

(7) the recording medium has particularly good ink fixation since the same number of droplets as the number of the colors of ink may sometimes adhere overlapping at the same portion;

(8) the surface is glossy;

(9) it has high whiteness;

(10) recorded images have high light fastness;

(11) the recording medium has high blocking resistance without any stickiness on its surface of ink-received portions; etc.

The recorded images formed by the ink jet recording process have been hitherto used solely for surface image observation, but, accompanying improved performance characteristics and widespread use of ink jet recording devices, recording media suitable for uses other than surface image observation are being sought after. The use of the recording medium for other than the surface image observation may include a case in which images formed by projecting recorded images on a screen or the like by means of optical equipment such as a slide and an OHP (over head projector) are observed, a color separation plate used when producing a positive plate for color printing, a CMF (color mosaic filter) used for color display by liquid crystals, etc.

While diffused light of recorded images is principally observed when a recording medium is used for surface image observation, what is required in the recording medium for the above uses is transmitted light of the recorded images. Thus, in addition to the characteristics required in the recording medium for the ordinary ink jet recording, the recording medium is further required to be excellent in the light transmission properties, in particular, the linear transmittance.

However, in the present state of the art, no recording medium that has satisfied all of these required characteristics has been available.

Moreover, many of the conventional recording media for the surface image observation have employed a system in which a porous ink receiving layer is provided on its surface and ink is received in porous voids in the layer to fix a recording agent. Accordingly, because of the porousness, there has been no gloss on the surface of the recording media. On the other hand, there are strong demands for a recording medium having gloss on the surface or a recording medium having good light transmission properties, as mentioned above. It is essential for such a recording medium that the ink receiving layer has a non-porous surface. However, when the ink receiving layer has a non-porous surface, there have involved problems that non-volatile components in ink, such as polyvalent alcohols, remain unremoved from the surface of the recording medium for a long time after recording to prolong the time for drying and fixing ink, whereby clothes may be soiled when coming into contact with the recorded images, or the recorded images may be damaged.

To cope with such problems, attempts have been hitherto made to form a non-porous ink receiving layer by use of a water soluble polymer having a good affinity for ink.

For example, Laid-Open Japanese Patent Application No. 44386/1985 proposes a light transmissive recording medium comprising an ink receiving layer formed on a polyester film by using polyvinyl alcohol. However, in such a recording medium, although having good linear transmittance and ink receptivity, there is a problem that hydrogen bonds between polyvinyl alcohol molecules become so strong when printing is carried out in an atmosphere of low temperature and low humidity that the ink receptivity may be extremely lowered.

U.S. Pat. No. 4,503,111 also proposes a recording medium comprising a non-porous ink receiving layer formed by mainly using polyvinyl pyrrolidone. However, such a recording medium involves a problem that the light fastness of recorded images is so poor or the stickiness of the surface of ink receiving layer having received ink is so strong that blocking may occur when printed matters are overlapped each other or a paper or the like is placed on a recording face.

SUMMARY OF THE INVENTION

Accordingly, an object of the present invention is to provide a recording medium for ink jet recording, which is excellent, in particular, in the ink receptivity and the sharpness of recorded images.

Another object of the present invention is to provide a recording medium for ink jet recording, which is capable of forming recorded images excellent, in particular, in the ink receptivity, the ink coloring property, the resolution and the light fastness, and, after recording, retaining images having a good blocking property against other recording medium, paper or the like.

Still another object of the present invention is to provide a recording medium for full-color ink jet recording, which is excellent in the ink receptivity, the sharpness of recorded images and the surface gloss.

Still another object of the present invention is to provide a recording medium for ink jet recording, which can be used for observation of images by projecting recorded images on a screen or the like by means of optical equipments such as a slide and an OHP; for a color separation plate used when producing a positive plate for color printing; or for observation of transmitted light such as a CMF (color mosaic filter) used for color display by use of liquid crystals, etc.

The above objects and other objects of the present invention can be achieved by the invention described below.

According to an embodiment of the present invention, there is provided a recording medium comprising an ink receiving layer provided on a substrate, wherein said ink receiving layer contains a cationically modified product of polyvinyl alcohol and a water soluble polymer having no active hydrogen.

In another embodiment of the invention, the ink receiving layer may be non-porous.

The water soluble polymer is contained preferably in an amount ranging between 1 part by weight and 33 parts by weight based on 100 parts by weight of the cationically modified product.

According to the present invention, there is also provided a process for carrying out recording by attaching droplets of a recording liquid to a recording medium, wherein said recording liquid comprises a water soluble dye, and a recording surface of said recording medium comprises a cationically modified product of polyvinyl alcohol and a water soluble polymer having no active hydrogen.

DETAILED DESCRIPTION OF THE PREFERRED EMBODIMENTS

Describing the present invention in detail, the recording medium of the present invention is chiefly characterized by a recording face thereof containing a water soluble, cationically modified product of polyvinyl alcohol (hereinafter "PVA") and a water soluble polymer having no active hydrogen (hereinafter "Polymer-A"). Chiefly because of this, the objects of the invention can be achieved.

The recording medium of the present invention generally comprises a substrate as a support, and an ink receiving layer, particularly a non-porous ink receiving layer, provided on the surface of the substrate. Particularly preferred embodiments thereof may include, for example;

(1) an embodiment wherein both of the substrate and the ink receiving layer are light transmissive and the recording medium is light transmissive as a whole;

(2) an embodiment wherein the surface of the ink receiving layer is smooth and glossy; etc.

In another embodiment, the ink receiving layer in each of the above embodiments may simultaneously serve as a substrate.

The present invention will be described further in detail by referring the above several preferred embodiments as typical examples. The cationically modified product of PVA firstly characterizing the present invention is meant to be PVA having a cationic group such as a primary to tertiary amino group or a quaternary ammonium salt group in a main chain or a side chain. In general, PVA can be obtained by saponifying polyvinyl acetate by acid saponification or alkali saponification. However, the cationically modified product of PVA firstly characterizing the present invention is obtained, when polymerizing the starting vinyl acetate, by polymerizing vinyl acetate with a vinyl compound monomer capable of being readily modified to a cationic group, followed by saponification of the resulting copolymer according to a conventional method. Such a vinyl compound monomer may include one or more of vinyl monomers containing quaternary ammonium salts (or precursor groups thereof, i.e., primary to tertiary amino groups) such as vinyloxy ethyl trimethylammonium chloride, 2,3-dimethyl-1-vinylimidazolinium chloride, trimethyl-(3-acrylamido-3,3-dimethylpropyl)ammonium chloride, trimethyl-(3-methacrylamidopropyl-)ammonium chloride, N-(1,1-dimethyl-3-dimethylaminopropyl)acrylamide and N-(3-dimethylaminopropyl)mathacrylamide, or o-, m- and p-aminostyrenes or monoalkyl or dialkyl derivates of these, or tertiary ammonium salts thereof; o-, m- and p-vinylbenzylamines or monoalkyl or dialkyl derivatives of these, or quaternary ammonium salts thereof; and other nitrogen-containing heterocyclic vinyl compounds such as N-(vinylbenzyl)pyrrolidine, N-(vinylbenzyl)piperidine, N-vinyl pyrrolidone, alpha- and beta-vinylpyridines or quaternary ammonium salts thereof, alpha- and beta-piperidines or quaternary ammonium salts thereof, and 2- and 4-vinylquinoline or quaternary ammonium salts thereof, or nitro derivatives of these. Alternatively, it may be obtained by copolymerizing vinyl acetate with other monomers having a reactive group in advance, and, after saponification, utilizing such a reactive group, PVA may be cationically modified by reacting it with a compound containing a cationic group. Still alternatively, PVA may be directly cationized by using a compound simultaneously having a group capable of reacting with its hydroxyl group and a primary to tertiary amino group or a quaternary ammonium group; for example, glycidyl trimethylammonium chloride and the like.

The cationic group of the cationically modified product of PVA may be present, when represented in terms of the molar fraction of the monomer unit in the polymer, in an amount ranging between 0.05 and 20 mole %, preferably 0.1 to 10 mole %, of the total monomer units. The amount of cationic group of 0.05 mole % or less may result in insufficient effects in the ink jet recording properties such as water resistance of an ink receiving layer, resolution, and coloring properties, as compared with unmodified ones. On the other hand, the amount of 20 mole % or more may result in poor adhesion of a substrate to the ink receiving layer or poor film formation property thereof, undesirably.

The saponification degree of the PVA which is the backbone polymer is preferably about 80 to 99 mole %.

The polymerization degree of the cationically modified product of PVA is preferably 500 to 5,000, more preferably 800 to 3,000. In any cases, there may be used a mixture of those having different polymerization degree and saponification degree.

Since, in general, an acidic direct dye is widely used in ink for ink jet recording, the ink receiving layer may preferably contain a cationic substance in view of the ink absorption, the coloring properites or fixation of a dye.

However, when the ink receiving layer is formed by using a mixture of PVA with a cationic surface active agent or a cationic polymer, the compatibility between both the coponents in the above mixture may become insufficient. Accordingly, decrease in adhesion, opaqueness due to insufficient compatibility, deterioration of ink jet recording properties during a long term storage and so forth have often occurred. In the present invention, on the contrary, since the cationically modified product of PVA used herein has a cationic group in its molecular chain or side chain, the disadvantages as mentioned above may not be caused even when it is used by mixing it with the cationic surface active agent or the cationic polymer to form the ink receiving layer. Moreover, since the cationically modified product of PVA used in the present invention has the cationic group in its molecular chain or side chain, the crystallization of PVA can be controlled to make it possible to improve the ink receptivity and retain the transparency when used in the ink receiving layer. There can be also obtained an effect that the ink receptivity can be improved also under the conditions of low temperature and low humidity.

According to detailed studies made by the present inventors, although a recording medium having various advantages as mentioned above can be obtained when an ink receiving layer is formed by using alone the cationically modified product of PVA, it still shows insufficient ink fixation under the conditions of low temperature and low humidity to bring about problems that it can have good compatibility only with a particular ink as to compatibility of water-soluble inks, resulting in lack in the general-purpose properties, and may allow the crystallization of polymers due to active hydrogen to proceed gradually even at an ordinary temperature, resulting in decrease in the ink absorption. As a result of intensive studies to solve such problems, the problems involved in the sole use of the cationically modified product of PVA have been sufficiently solved by adding Polymer-A to the cationically modified product of PVA.

Polymer-A used in the present invention and secondly characterizing the present invention is a water soluble polymer, and any of known polymers having no active hydrogen can be used. Preferable examples thereof includes homopolymers of vinyl monomers such as vinyl pyrrolidone (e.g., N-vinyl pyrrolidone, N-vinyl-3-methyl pyrrolidone, N-vinyl-5-methyl pyrrolidone, N-vinyl-3,3,5-trimethyl pyrrolidone, and N-vinyl-3-benzyl pyrrolidione) or derivatives thereof and vinyl ether (e.g., vinyl methyl ether); random copolymers, block copolymers or graft copolymers thereof with other ordinary monomers; etc. In the case of the copolymers, the vinyl pyrrolidone or the like monomers constituting a copolymer may preferably amount to 50 mole % or more.

Accordingly, a principal feature of the present invention resides in that an ink receiving layer of a recording medium is formed by using the above cationically modified product of PVA and the above Polymer-A, and employment of such cationically modified product of PVA and Polymer-A makes it possible to obtain a recording medium that can give recorded images excellent in the above-mentioned various required performances, in particular, the ink receptivity under the conditions of low temperature and low humidity and the blocking resistance, and also excellent in the light fastness, storability, sharpness and so forth.

It has been also found that the amount of Polymer-A in the cationically modified product of PVA is an important factor, and a best result can be obtained when Polymer-A is used in an amount of not less than 1 part by weight and not more than 33 parts by weight based on 100 parts by weight of the cationically modified product of PVA.

Using Polymer-A in the amount of 1 part or less by weight may result in no remarkable effects to solve the above problems, namely, to improve the ink absorption under the conditions of low temperature and low humidity or prevent the ink absorption from being lowered by the proceeding of crystallization. On the contrary, using in the amount of 33 parts or more by weight based on the cationically modified product of PVA tends to cause an inconvenience such a stickiness of printed portions, or tends to adversely affect the light fastness of images particularly when a polyvinyl pyrrolidone polymer is used as Polymer-A.

Conventionally, employing a mixture of polyvinyl alcohol and polyvinyl pyrrolidone for formation of an ink receiving layer has been known to give a recording medium having relatively good ink receptivity and recording suitability. However, it was essential to mix them in the ratio of PVA/PVP=3/1 to 1/3 (see U.S. Pat. No. 4,503,111, Tektronix), no problems have not been solved as to the lowering of light fastness or the blocking caused by use of polyvinyl pyrrolidone.

In the present invention, it is possible to obtain a recording medium having better ink receptivity and recording suitability when using Polymer-A in combination with the cationically modified product of PVA than when using a mixture of ordinary PVA and Polymer-A. Besides, it is also possible to obtain a recording medium having solved the above various problems caused by the crystallization of PVA molecules, even when used within the range in which the adverse influence by Polymer-A may not be caused, namely, the range of not more than one-third of the cationically modified product of PVA.

The substrate used in the present invention as a support for the ink receiving layer may be any of conventionally known transparent or opaque substrates. Preferable examples of the transparent substrates may include films, plates, glass plates, etc. of polyester resins, diacetate resins, triacetate resins, acrylic resins, polycarbonate resins, polyvinyl chloride resins, polyimide resins, cellophane, celluloid, etc. The opaque substrates may preferably include, for example, ordinary papers, cloths, metal plates, and synthetic papers, as well as those treated to make opaque the above transparent substrates according to a known method.

The recording medium of the present invention can be produced by using the chief materials as mentioned above, and the preferred embodiment (1) mentioned before is an embodiment wherein both of the substrate and the ink receiving layer are light transmissive and the recording medium is light transmissive as a whole. The recording medium according to this embodiment, having good light transmission properties in particular, is mainly used in the case where recorded images are projected on a screen by means of an optical equipment such as OHP, and useful as a recording medium for observation of transmitted light.

Such a light transmissive recording medium can be prepared by forming on the light transmissive substrate as mentioned above a light transmissive ink receiving layer made from a mixture of the cationically modified product of PVA and Polymer-A as mentioned above, or a mixture of these with other light transmissive polymer(s).

As a method for formation of such an ink receiving layer, preferable is a method comprising dissolving or dispersing the above mixture of the cationically modified product of PVA and Polymer-A, or the mixture of these with other polymer(s), in a suitable solvent to prepare a coating solution, and applying the solution onto the light transmissive substrate by a known coating method such as roll coating, rod bar coating, spray coating and air knife coating, followed by immediately drying. Other methods may be also available, such as a method in which the materials as mentioned above are applied by hot melt coating or a method in which a sheet for the ink receiving layer is independently formed in advance from the materials as mentioned above and the sheet is then laminated on the substrate.

Preferable examples of other polymer(s) that can be used in the above method in combination with the cationically modified product of PVA and Polymer-A may include natural resins such as albumin, gelatin, casein, starch, cationic starch, gum arabic and sodium alginate; synthetic resins such as polyamide, polyacrylamide, polyethyleneimine, polyvinylpyridylium halide, melamine resins, polyurethane, carboxymethyl cellulose, polyvinyl alcohol, polyester, sodium polyacrylate, SBR latex, NBR latex, polyvinyl formal, polymethyl methacrylate, polyvinyl butyral, polyacrylonitrile, polyvinyl chloride, polyvinyl acetate, phenol resins and alkyd resins; etc., and one or more of them may be optionally used. When these light transmissive polymers are used in combination with the above cationically modified product of PVA and Polymer-A, they are used in the range of 20:1 to 1:20, preferably 15:1 to 1:10 in weight ratio of the cationically modified product of PVA and Polymer-A to other polymer.

In order to more improve the ink receptivity of the ink receiving layer in the methods as mentioned above, a filler such as silica, clay, talc, diatomaceous earth, calcium carbonate, calcium sulfate, barium sulfate, aluminum silicate, synthetic zeolite, alumina, zinc oxide, lithopone and satin white can be dispersed in the ink receiving layer so far as the light transmission properties of the recording medium may not be impaired.

The recording medium produced as above according to the embodiment (1) is a light transmissive recording medium having sufficient light transmission properties.

The sufficient light transmission properties mentioned in the present invention means that the recording medium has a linear transmittance of at least 2%, preferably, of 10% or more.

The light transmittance of 2% or more makes it possible to observe recorded images by projecting them on a screen by using, for example, OHP, furthermore the light transmittance of 10% or more is preferable for vivid observation of details of recording images.

The linear transmittance T (%) herein used is a value obtained by measuring, with use of, for example, Type 323 Hitachi Autographic Spectrophotometer (manufactured by Hitachi Seisakusho), spectral transmittance of linear light vertically incident on a sample, transmitting through the sample, and passing through a slit provided at least 8 cm distant from the sample at the light receiving side on an extension line of the incident light path; determining further the value Y of the tristimulus value of color from the spectral transmittance thus measured; and calculating it according to the following formula:

$$T = Y/Yo \times 100 \quad \text{(I)}$$

wherein

T: linear transmittance;

Y: Value Y of the sample; and

Yo: Value Y of a blank.

Accordingly, the linear transmittance referred to in the present invention is concerned with linear light, and different from evaluation of the light transmission properties by diffused light, such as the diffused transmittance (i.e., the light transmittance of light including diffused light, determined by providing an integrating sphere at a rear portion of a sample) and the opacity (determined from the ratio obtained by applying a white and black lining to the back of a sample).

Since what is questioned in equipments utilizing optical techniques is the behavior of linear light, it is particularly important to determine the linear transmittance of a recording medium in order to evaluate the light transmission properties of a recording medium intended for use in such equipments.

For example, when projected images are observed by OHP, it is required that non-recording portions in the projected images are bright, in other words, the linear transmittance of a recording medium is higher than a given level, in order to obtain sharp and clear images having a high contrast between recording portions and non-recording portions. According to a test by a test chart using OHP, the linear transmittance of a recording medium is required to be 2% or more to obtain images answering the above object, and preferably 10% or more to obtain sharper images. Thus, the recording medium that can answer this object is required to have a linear transmittance of 2% or more.

Another preferred embodiment (2) mentioned before, which can be also another embodiment of the above embodiment (1), is characterized in that the surface of its ink receiving layer is smooth to have a 45° specular gloss according to JIS Z8741, of 30% or more. The recording medium of this type has good surface gloss in particular, and particularly useful as a recording medium for the surface image observation, having good sharpness in full color. The recording medium according to this embodiment may be either transparent or opaque, for which either of the above transparent substrate and opaque one can be used. Also, an ink receiving layer formed on these substrate may also be transparent or opaque. The materials and the method employed for formation of the ink receiving layer can be same as in the above embodiment (1), but the fillers mentioned above may be used as a level that may make opaque the ink receiving layer so far as the suface of the ink receiving layer can retain the smoothness.

If necessary, a cast coating method may be employed in place of the above coating methods, or glossing may be carried out by using a calender roll.

As still another embodiment in which the ink receiving layer serves also as a support, there can be a recording medium which is according to the embodiment (1) or (2), in which, however an ink receiving layer has been made thick, and from which the substrate has been peeled off.

In the present invention as described above, the ink receiving layer formed on a substrate has a thickness usually of about 1 to 200 μm, preferably about 5 to 100 μm.

In the foregoing, the present invention has been described by exemplifying typical embodiments of the recording medium of the invention, but, of course, by no means limited to these embodiments. In any of the embodiments, the ink receiving layer may contain a variety of known additives such as a dispersant, a fluorescent dye, a pH adjuster, an antifoamer, a lubricant, an anticeptic and a surface active agent.

The recording medium of the present invention may not necessarily be colorless, and a colored recording medium may also be available.

According to the above recording medium of the present invention, containing the cationically modified product of PVA and Polymer-A, has a good ink receptivity, and therefore there can be obtained images free from flow-out or oozing of ink even when ink of a different color has been applied overlapping on the same portion in a short time, and having high resolution, high sharpness, and good light fastness and blocking resistance. Moreover, it is also possible to provide a recording medium having an excellent surface gloss that has not been attained in the conventional recording media for ink jet recording, and use it not only for the conventional surface image observation, but also for observation of images by projecting recorded images on a screen or the like by means of optical equipments such as a slide and an OHP, for a color separation plate used when producing a positive plate for color printing, or for a CMF (color mosaic filter) used for color display by liquid crystals, etc.

In the foregoing, the object, the construction and the effects of the present invention have been described as a recording medium for ink jet recording. The recording medium of the present invention, however, is not limited only to the use for the ink jet recording, but of course can be used for every sort of recording carried out by using aqueous ink.

The present invention will be described in greater detail by the following Examples, Comparative Examples and Test Examples. Herein, "part" is meant to be part by weight.

EXAMPLES 1 TO 5

Using polyethylene terephthalate films of 100 μm thick (produced by Toray Industries, Inc.) as light transmissive substrates, the films were coated with a coating solution having the following makeup according to a bar coater method so as to have a film thickness of 15 μm after dried, followed by drying under the conditions of 80° C. for 10 minutes to obtain light transmissive recording media.

[COATING SOLUTION]

Example 1

| | |
|---|---|
| Cationically modified product of PVA (PVA-C-418-A; produced by Kuraray Co., Ltd.; a 10% aqueous solution) | 10 parts |
| Polyvinyl pyrrolidione (PVP K-90; produced by GAF Corp.; a 10% aqueous solution) | 3 parts |

Example 2

| | |
|---|---|
| Cationically modified product of PVA (PVA-C-318-2A; produced by Kuraray Co., Ltd.; a 10% aqueous solution) | 10 parts |
| Polyvinyl pyrrolidone (PVP K-30; produced by GAF Corp.; a 10% aqueous solution) | 1 part |

Example 3

| | |
|---|---|
| Cationically modified product of PVA (PVA-C-318; produced by Kuraray Co., Ltd.; a 10% aqueous solution) | 10 parts |
| Polyvinyl pyrrolidone (PVP K-90; produced by GAF Corp.; a 10% aqueous solution) | 3 parts |

Example 4

| | |
|---|---|
| Cationically modified product of PVA (PVA-C-118-2A; produced by Kuraray Co., Ltd.; a 10% aqueous solution) | 10 parts |
| Polyvinyl methyl ether (Lutonal M-40; produced by BASF Corp.; a 10% aqueous solution) | 3 parts |

Example 5

Example 1 was repeated except that a commercially available cast coated paper was used as a substrate, to obtain a recording medium of the invention having a glossy surface.

Comaparative Examples 1 to 3

Example 1 was repeated except that the following coating solutions were used.

[COATING SOLUTION]

Comparative Example 1

| | |
|---|---|
| Cationically modified produce of PVA (PVA-C-418-A; produced by Kuraray Co., Ltd.; a 10% aqueous solution) | 10 parts |

Comparative Example 2

| | |
|---|---|
| Polyvinyl alcohol (PVA-217; produced by Kuraray Co., Ltd.; a 10% aqueous solution) | 10 parts |
| Polyvinyl pyrrolidone (PVP K-90; produced by GAF Corp.; a 10% aqueous solution) | 3 parts |

Comparative Example 3

| | |
|---|---|
| Polyvinyl alcohol (PVA-217; produced by Kuraray Co., Ltd.; a 10% aqueous solution) | 10 parts |
| Polyvinyl pyrrolidone (PVP K-90; produced by GAF Corp.; a 10% aqueous solution) | 10 parts |

On each of the recording media obtained in the above Examples and Comparative Examples, ink jet recording was carried out using a recording apparatus equipped with an on-demand type ink jet recording head capable of forcing ink to eject by means of a piezoelectric oscillator (ejection orifice diameter: 60 μm; driving voltage of piezoelectric oscillator: 70 V; frequency: 2 kHz), with use of the following four kinds of ink.

| | |
|---|---|
| Yellow ink (makeup) | |
| C.I. Direct Yellow 86 | 2 parts |
| Diethylene glycol | 20 parts |
| Polyethylene glycol #200 | 10 parts |
| Water | 70 parts |
| Red ink (makeup) | |
| C.I. Acid red 35 | 2 parts |
| Diethylene glycol | 20 parts |
| Polyethylene glycol #200 | 10 parts |
| Water | 70 parts |
| Blue ink (makeup) | |
| C.I. Direct Blue 86 | 2 parts |
| Diethylene glycol | 20 parts |
| Polyethylene glycol #200 | 10 parts |
| Water | 70 parts |
| Black ink (makeup) | |
| C.I. Food Black 2 | 2 parts |
| Diethylene glycol | 20 parts |
| Polyethylene glycol #200 | 10 parts |
| Water | 70 parts |

Results obtained from evaluations on the recording media according to Examples and Comparative Examples are shown in Table 1. The respective evaluation items in Table 1 were measured according to the following methods:

(1) Ink fixing time was measured in terms of the time by which ink had dried not to stick to fingers when recorded images were touched with fingers after a recording medium on which recording had been performed was left under the conditions of predetermined temperature and humidity.

(2) Dot density was measured on black dots by applying JIS K7605 to printed microdots with use of Sakura Microdensitometer PDM-5 (produced by Konishiroku Photo Industry, Ltd.).

(3) OHP suitability was measured as OHP is a typical example of optical equipments, and judged by visual observation of images formed by projecting recorded images on a screen by using OHP. Where non-recording portions were bright, recorded images had high OD (optical density), and sharp and clear projected images having high contrast were obtained, the sample was evaluated as ○ ; where non-recording portions were somewhat dark, recorded images had somewhat low OD, and a line of 0.5 mm in pitch width and 0.25 mm in thickness could not be clearly distinguished, the sample was evaluated as Δ; and where non-recording portions were considerably dark, recorded images had considerably low OD, and a line of 1 mm in pitch width and 0.3 mm in thickness could not be clearly distinguished or there was no distinction between non-recording portions and recording portions, the sample was evaluated as X.

(4) Linear transmittance was determined according to the above formula (I), by measuring spectral transmittance using Type 323 Hitachi Autographic Spectrophotometer (manufacturing by Hitachi Ltd.), keeping a window at the light-receiving side at about 9 cm distant from the sample.

(5) Gloss was measured according to JIS Z-8741 for 45° specular gloss on the surface of a recording medium.

(6) Light-fastness was determined by making 50 hour irradiation using a xenon fadeometer FAL-25AX-HC Type (produced by Suga test Instruments Co.) to measure color difference (Lab) from a sample of no irradiation by using NP-1001DP (produced by Nihon Denshoku Co.).

(7) Blocking resistance was measured in the following manner: One hour after printing, a woodfree paper was brought into close contact with the face of prints, and stored for 12 hours as it is. After storage, the sample that caused no sticking between the recording medium and the woodfree paper was evaluated as ○; and the sample to the contrary, as X. Similar tests were carried out 10 minutes after printing, and the sample that caused no sticking was evaluated as ⊙ .

(8) Carrying performance was determined in the following manner: When a recording medium was set in a printer under the conditions of 26° C. and 75% RH, the sample that could not be carried by a carrying roll of the printer because of the stickiness on the surface of an ink receiving layer and could not perform recording was evaluated as X; and the sample to the contrary, as ○.

TABLE 1

| | Evaluation item | | | | | | | | | | | | |
|---|---|---|---|---|---|---|---|---|---|---|---|---|---|
| | Ink fixing time | | | | | | Light-fastness(E) Color of Ink | | | | | | |
| | 10° C., 30% RH | 20° C., 65% RH | Dot density | OHP suitability | Linear transmittance | 45° specular gloss | Yellow | Red | Blue | Black | Blocking resistance | Carrying performance | Overall evaluation |
| Example | | | | | | | | | | | | | |
| 1 | 2 min. | <1 min. | 1.1 | ○ | 80% | — | 0.6 | 3.4 | 1.6 | 4.0 | ○ | ○ | ○ |
| 2 | 1 min. | <1 min. | 1.1 | ○ | 81% | — | 0.3 | 0.7 | 1.4 | 2.8 | ○ | ○ | ○ |
| 3 | 2 min. | 1 min. | 1.1 | ○ | 80% | — | 0.7 | 4.6 | 3.0 | 5.1 | ○ | ○ | ○ |
| 4 | 3 min. | 1 min. | 1.1 | ○ | 80% | — | 0.4 | 0.9 | 1.8 | 2.2 | ○ | ○ | ○ |
| 5 | 2 min. | <1 min. | 0.9* (reflected) | — | — | 70% | 2.3* | 6.6* | 1.7* | 6.2* (reflected) | ○ | ○ | ○ |
| Comparative Example | | | | | | | | | | | | | |
| 1 | 10 min. | 1 min. | 1.0 | ○ | 81% | — | 0.3 | 0.6 | 1.1 | 2.7 | ○ | ○ | Δ |
| 2 | 20 min. | 3 min. | 1.1 | ○ | 82% | — | 0.4 | 3.5 | 2.4 | 5.4 | ○ | ○ | X |

TABLE 1-continued

| | Evaluation item | | | | | | | | | | | | |
|---|---|---|---|---|---|---|---|---|---|---|---|---|---|
| | Ink fixing time | | | OHP | Linear | 45° | Light-fastness(E) | | | | Blocking | Carrying | Overall |
| | 10° C., 30% RH | 20° C., 65% RH | Dot density | suitability | transmittance | specular gloss | Color of Ink: Yellow | Red | Blue | Black | resistance | performance | evaluation |
| 3 | 5 min. | 1 min. | 1.1 | O | 82% | — | 1.0 | 26.1 | 4.4 | 16.2 | X | X | X |

We claim:

1. A recording medium, comprising:

an ink receiving layer provided on a substrate, wherein said ink receiving layer contains a cationically modified product of polyvinyl alcohol and a water soluble polymer having no active hydrogen, said water soluble polymer being contained in an amount of from 1–33 parts by weight per 100 parts by weight of cationically modified product, and wherein said recording medium has a linear transmittance of at least 2%.

2. The recording medium according to claim 1, wherein said ink receiving layer has a smooth surface.

3. The recording medium according to claim 1, wherein the surface of said ink receiving layer has a 45° specular gloss of 30% or more according to JIS Z-8741.

4. The recording medium according to claim 1, wherein said ink receiving layer has a thickness ranging between 1 and 200 μm.

5. The recording medium according to claim 1, wherein said ink receiving layer has a thickness ranging between 5 and 100 μm.

6. The recording medium according to claim 1, wherein said cationically modified product of polyvinyl alcohol is a polyvinyl alcohol having a cationic group in a main chain or a side chain.

7. The recording medium according to claim 6, wherein said cationic group is a primary to tertiary amino group or a quaternary ammonium salt group.

8. The recording medium according to claim 6, wherein the cationic group of the cationically modified product of PVA is present in an amount ranging between 0.05 and 20 mole %.

9. The recording medium according to claim 1, wherein the polymerization degree of the cationically modified product of PVA ranges from 500 and 5,000.

10. The recording medium according to claim 1, wherein said water soluble polymer having no active hydrogen is a material selected from the group consisting of a polymer of vinyl pyrrolidone or derivatives thereof, a polymer of vinyl monomers, a random copolymer, a block copolymer and a graft copolymer thereof with other monomers.

11. A recording medium, comprising:

an ink receiving layer provided on a substrate, wherein said ink receiving layer is non-porous and contains a cationically modified product of polyvinyl alcohol and a water soluble polymer having no active hydrogen, said water soluble polymer being contained in an amount of from 1–33 parts by weight per 100 parts by weight of cationically modified product, and wherein a recording surface of the ink receiving layer has a 45° specular gloss of at least 30% according to JIS Z-8741.

12. The recording medium according to claim 11, wherein said recording medium has a linear transmittance of 2% or more.

13. The recording medium according to claim 11, wherein said ink receiving layer has a smooth surface.

14. The recording medium according to claim 11, wherein said ink receiving layer has a thickness ranging between 1 and 200 μm.

15. The recording medium according to claim 11, wherein said ink receiving layer has a thickness ranging between 5 and 100 μm.

16. The recording medium according to claim 11, wherein said cationically modified product of polyvinyl alcohol is a polyvinyl alcohol having a cationic group in a main chain or a side chain.

17. The recording medium according to claim 16, wherein said cationic group is a primary to tertiary amino group or a quaternary ammonium salt group.

18. The recording medium according to claim 16, wherein the cationic group of the cationically modified product of PVA is present in an amount ranging between 0.05 and 20 mole %.

19. The recording medium according to claim 16, wherein the polymerization degree of the cationically modified product of PVA ranges between 500 and 5,000.

20. The recording medium according to claim 11, wherein said water soluble polymer having no active hydrogen is a material selected from the group of consisting of a polymer of vinyl pyrrolidone or derivatives thereof, a polymer of vinyl monomers, a random copolymer, a block copolymer and a graft copolymer thereof with other monomers.

21. A recording medium comprising an ink receiving layer provided on a substrate, wherein said ink receiving layer contains a cationically modified product of polyvinyl alcohol and a water soluble polymer having no active hydrogen, and said water soluble polymer is contained in an amount ranging between 1 part by weight and 33 parts by weight based on 100 parts by weight of said cationically modified product.

22. The recording medium according to claim 21, wherein said ink receiving layer has a smooth surface.

23. The recording medium according to claim 21, wherein the surface of said ink receiving layer has a 45° specular gloss of 30% or more according to JIS Z-8741.

24. The recording medium according to claim 21, wherein said ink receiving layer has a thickness ranging between 1 and 200 μm.

25. The recording medium according to claim 21, wherein said ink receiving layer has a thickness ranging between 5 and 100 μm.

26. The recording medium according to claim 21, wherein said cationically modified product of polyvinyl alcohol is a polyvinyl alcohol having a cationic group in a main chain or a side chain.

27. The recording medium according to claim 26, wherein said cationic group is a primary to tertiary amino group or a quaternary ammonium salt group.

28. The recording medium according to claim 26, wherein the cationic group of the cationically modified product of PVA is present in an amount ranging between 0.05 and 20 mole %.

29. The recording medium according to claim 21, wherein the polymerization degree of the cationically modified product of PVA ranges between 500 and 5,000.

30. The recording medium according to claim 21, wherein said water soluble polymer having no active hydrogen is a material selected from the group consisting of a polymer of vinyl pyrrolidone or derivatives thereof, a polymer of vinyl monomers, a random copolymer, a block copolymer and a graft copolymer thereof with other monomers.

* * * * *

UNITED STATES PATENT AND TRADEMARK OFFICE

CERTIFICATE OF CORRECTION

PATENT NO. : 4,801,497

DATED : January 31, 1989

INVENTOR(S) : SHUNZO KONO, ET AL.

It is certified that error appears in the above-identified patent and that said Letters Patent is hereby corrected as shown below:

IN [56] REFERENCES CITED

U.S. Patent Documents, "Togahoh et al." should read --Toganoh et al.--

COLUMN 4

Line 33, "trimethyl-(3-methacrylamidopropyl-" should read --trimethyl-(3-methacrylamidopropyl) ammonium--.
Line 34, ")ammonium should be deleted.

COLUMN 5

Line 42, "by using alone" should read --using only--.
Line 43, "PVA," should read --PVA, but--.
Line 45, "to bring about problems" should read --so that it has--.
Line 46, "that it can have" should be deleted.

COLUMN 6

Line 31, "a" should read --as--.

COLUMN 8

Line 18, "T=Y/Yox100" should read --T=(Y/Yo)x100--.

COLUMN 9

Line 24, "anticeptic" should read --antiseptic--.
Line 61, "100.um" should read --100 um--.

UNITED STATES PATENT AND TRADEMARK OFFICE

CERTIFICATE OF CORRECTION

PATENT NO. :4,801,497

DATED :January 31, 1989

INVENTOR(S) :SHUNZO KONO, ET AL.

It is certified that error appears in the above-identified patent and that said Letters Patent is hereby corrected as shown below:

COLUMN 14

Line 34, "of" should be deleted.

Signed and Sealed this

Twenty-ninth Day of August, 1989

*Attest:*

*Attesting Officer*

DONALD J. QUIGG

*Commissioner of Patents and Trademarks*